US010475435B1

(12) United States Patent
Dominijanni et al.

(10) Patent No.: US 10,475,435 B1
(45) Date of Patent: Nov. 12, 2019

(54) EARPHONE HAVING ACOUSTIC IMPEDANCE BRANCH FOR DAMPED EAR CANAL RESONANCE AND ACOUSTIC SIGNAL COUPLING

(71) Applicant: Bose Corporation, Framingham, MA (US)

(72) Inventors: Andrew D. Dominijanni, Newton, MA (US); Ryan C. Struzik, Hopkinton, MA (US); Lei Cheng, Wellesley, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/210,784

(22) Filed: Dec. 5, 2018

(51) Int. Cl.
*H04R 1/10* (2006.01)
*G10K 11/16* (2006.01)
*G10K 11/178* (2006.01)

(52) U.S. Cl.
CPC ..... *G10K 11/17823* (2018.01); *H04R 1/1016* (2013.01); *H04R 1/1041* (2013.01); *G10K 2210/1081* (2013.01); *G10K 2210/3044* (2013.01)

(58) Field of Classification Search
CPC ..... H04R 1/02; H04R 1/10; H04R 1/1016; H04R 1/1041; H04R 1/1075; H04R 1/1083; H04R 1/1091; H04R 1/28; H04R 3/00; H04R 3/04; H04R 25/60; H04R 25/405; G10K 11/16; G10K 11/178; G10K 11/17823; G10K 2210/10; G10K 2210/108; G10K 2210/1081; G10K 2210/3044
See application file for complete search history.

(56) References Cited

U.S. PATENT DOCUMENTS 4,006,321 A 2/1977 Carlson
4,807,612 A 2/1989 Carlson
8,081,769 B2 12/2011 Fukuda et al.
8,238,568 B2 8/2012 Miseki et al.
(Continued)

FOREIGN PATENT DOCUMENTS

EP 2768239 A1 8/2014
EP 3214852 A1 9/2017
(Continued)

*Primary Examiner* — Thang V Tran
(74) *Attorney, Agent, or Firm* — Schmeiser, Olsen & Watts LLP; William G. Guerin

(57) ABSTRACT

An earphone includes an earphone assembly and first and second electro-acoustic transducers. The earphone assembly includes an earphone body with an inner surface, an acoustic opening and a cavity defined inside the body by the inner surface and the acoustic opening. The earphone body further includes an acoustic impedance branch, such as a wave-guide, that reduces a magnitude of a resonance at a first resonance frequency for an occluded ear canal defined by the cavity of the earphone assembly and an ear canal of a user when the earphone is at least partially inserted into the ear canal. The first electro-acoustic transducer is disposed at the inner surface of the earphone body and is configured to generate a first acoustic signal. The second electro-acoustic transducer is disposed along a length of the acoustic impedance branch and is configured to generate a second acoustic signal.

19 Claims, 6 Drawing Sheets

(56) References Cited

U.S. PATENT DOCUMENTS

| | | | | |
|---|---|---|---|---|
| 2007/0036385 | A1* | 2/2007 | Harvey | H04R 1/2819<br>381/388 |
| 2011/0058702 | A1* | 3/2011 | Saggio, Jr. | H04R 1/1016<br>381/380 |
| 2012/0191004 | A1* | 7/2012 | Iseberg | A61B 5/121<br>600/559 |
| 2012/0294465 | A1 | 11/2012 | Vlach et al. | |
| 2013/0343564 | A1* | 12/2013 | Darlington | H04R 1/1016<br>381/74 |
| 2014/0241562 | A1* | 8/2014 | Monahan | H04R 1/1016<br>381/380 |
| 2015/0113795 | A1* | 4/2015 | Depallens | H04R 31/00<br>29/594 |

FOREIGN PATENT DOCUMENTS

| | | | |
|---|---|---|---|
| GB | 2408405 | A | 5/2005 |
| GB | 2454605 | A | 5/2009 |
| WO | 2007089845 | A2 | 8/2007 |

* cited by examiner

EARPHONE HAVING ACOUSTIC IMPEDANCE BRANCH FOR DAMPED EAR CANAL RESONANCE AND ACOUSTIC SIGNAL COUPLING

BACKGROUND

This disclosure relates to an in-ear audio device having one or more acoustic impedance branches that dampen the resonance of the occluded ear canal formed between the cavity of an earphone and the ear canal of a user. More particularly, the audio device may be an earphone and include one or more electro-acoustic transducers coupled to one or more of the acoustic impedance branches which may be provided as acoustic waveguides.

SUMMARY

In one aspect, an earphone includes an earphone assembly, a first electro-acoustic transducer and a second electro-acoustic transducer. The earphone assembly has an earphone body with an inner surface, an acoustic opening and a cavity defined by the inner surface and the acoustic opening. The earphone assembly further includes a first acoustic impedance branch extending from an open end at the inner surface to a closed end inside the earphone body. The first acoustic impedance branch includes a branch volume that reduces a magnitude of a resonance at a first resonance frequency for an occluded ear canal defined by the cavity of the earphone assembly and an ear canal of a user when the earphone is at least partially inserted into the ear canal. The first electro-acoustic transducer is disposed inside the earphone assembly and is configured to generate a first acoustic signal in response to a first electrical signal. The second electro-acoustic transducer is disposed inside the earphone body along a length of the first acoustic impedance branch and is configured to generate a second acoustic signal in response to a second electrical signal.

Examples may include one or more of the following features:

The first acoustic impedance branch may include an acoustic waveguide. The waveguide may have a length equal to one quarter of an acoustic wavelength for the first resonance frequency.

The first electro-acoustic transducer may be disposed at the inner surface of the earphone body. The second electro-acoustic transducer may be disposed at the closed end of the first acoustic impedance branch. The first electro-acoustic transducer and the second electro-acoustic transducer may be different sizes.

The earphone assembly may further include a second acoustic impedance branch extending from the inner surface into the earphone body. The first electro-acoustic transducer may be disposed inside the earphone body along a length of the second acoustic impedance branch. The first electro-acoustic transducer may be disposed at a closed end of the second acoustic impedance branch.

The first electro-acoustic transducer and the second electro-acoustic transducer may generate acoustic signals having different frequency content.

In accordance with another aspect, an acoustic noise reduction earphone includes an earphone assembly, a first electro-acoustic transducer, a second electro-acoustic transducer, at least one of a feedforward microphone and a feedback microphone, and a circuit. The earphone assembly has an earphone body with an inner surface and an external surface, an acoustic opening and a cavity defined by the inner surface and the acoustic opening. The earphone assembly further includes a first acoustic impedance branch extending from an open end at the inner surface to a closed end inside the earphone body. The first acoustic impedance branch includes a branch volume that reduces a magnitude of a resonance at a first resonance frequency for an occluded ear canal defined by the cavity of the earphone assembly and an ear canal of a user when the earphone is at least partially inserted into the ear canal. The first electro-acoustic transducer is disposed inside the earphone assembly and is configured to generate a first acoustic signal in response to a first electrical signal and the second electro-acoustic transducer is disposed inside the earphone body along a length of the acoustic impedance branch and is configured to generate a second acoustic signal in response to a second electrical signal. The feedforward microphone is disposed on the external surface of the earphone body and is configured to generate a feedforward electrical signal in response to an external acoustic signal. The feedback microphone is disposed in the cavity and is configured to generate a feedback electrical signal in response to a cavity acoustic signal, i.e., an acoustic signal propagating within the cavity. The circuit is in electrical communication with the first and second electro-acoustic transducers and in electrical communication with at least one of the feedforward microphone and the feedback microphone. The circuit generates the first and second electrical signals received by the first and second electro-acoustic transducers, respectively, in response to at least one of the feedback electrical signal and the feedforward electrical signal.

Examples may include one or more of the following features:

The first acoustic impedance branch may include an acoustic waveguide. The waveguide may have a length equal to one quarter of an acoustic wavelength for the first resonance frequency.

The first electro-acoustic transducer and the second electro-acoustic transducer may generate acoustic signals having different frequency content.

In accordance with another aspect, an earphone includes an earphone assembly, a first electro-acoustic transducer and a second electro-acoustic transducer. The earphone assembly has an earphone body with an inner surface, an acoustic opening and a cavity defined by the inner surface and the acoustic opening. The earphone assembly further includes a waveguide extending from an open end at the inner surface to a closed end inside the earphone body. The waveguide reduces a magnitude of a resonance at a first resonance frequency for an occluded ear canal defined by the cavity of the earphone assembly and an ear canal of a user when the earphone is at least partially inserted into the ear canal. The first electro-acoustic transducer is disposed in the earphone assembly and is configured to generate a first acoustic signal in response to a first electrical signal. The second electro-acoustic transducer is disposed in the earphone body along a length of the waveguide and is configured to generate a second acoustic signal in response to a second electrical signal.

Examples may include one or more of the following features:

The waveguide may have a length equal to one quarter of an acoustic wavelength for the first resonance frequency.

The first electro-acoustic transducer may be disposed at the inner surface of the earphone body. The second electro-acoustic transducer may be disposed at the closed end of the waveguide. The first electro-acoustic transducer and the second electro-acoustic transducer may generate acoustic signals having different frequency content. The first electro-acoustic transducer and the second electro-acoustic transducer may be different sizes.

BRIEF DESCRIPTION OF THE DRAWINGS

The above and further advantages of examples of the present inventive concepts may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

Figure 1:
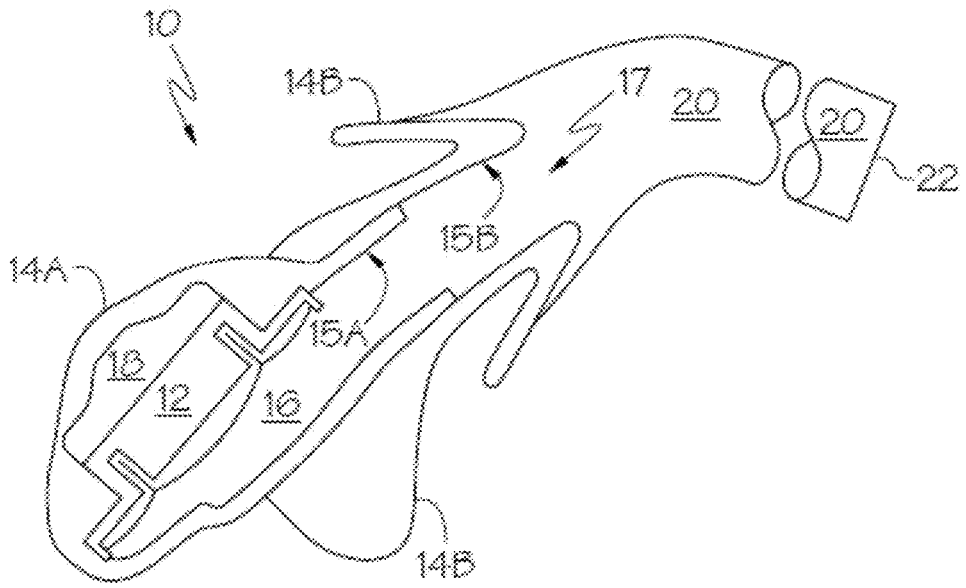
FIG. 1 is an illustration of a typical in-ear audio device inserted into an ear canal so as to form an occluded ear canal.

As shown in FIG. 1, a typical in-ear audio device, such as an earphone 10, includes an electro-acoustic transducer 12 (e.g., speaker) inside an earphone assembly 14. The earphone assembly 14 includes a body comprising a rigid body 14A and a compliant eartip 14B attached to the nozzle portion of the rigid body 14A. As used herein, the nozzle portion means the end portion of the rigid body 14A that is inserted furthest into the ear canal 20. The rigid body 14A may be formed as a hard plastic material. For example, the material may be a thermoplastic polymer such as acrylonitrile butadiene styrene ("ABS"). The earphone assembly 14 has an inner surface 15 and an acoustic opening 17. The inner surface 15 includes the inner surface 15A of the rigid body 14A and the internal surface 15B of the eartip 14B, and the acoustic opening 17 is at the open end of the eartip 14B. The eartip 14B is formed of a material that comfortably conforms to the entrance of an ear canal 20 of a user, such as silicone. The eartip 14B may be configured for removal from and re-attachment to the rigid body 14A. The speaker 12 is disposed inside the rigid body 14A such that an acoustic front cavity 16 is defined on the front side of the speaker 12 and an acoustic back cavity 18 is defined on the back side of the speaker 12. The acoustic back cavity 18 may be sealed, as shown, or it may be shunted (i.e., "ported") by way of one or more acoustic impedance paths to an external acoustic environment, to the front cavity 16, or to both the external acoustic environment and front cavity 16. Although not shown, the earphone 10 may include one or more microphones located in the front cavity 16 and/or one or more microphones disposed on the external surface of the rigid body 14A. In some implementations, the microphones may be feedback microphones and/or feedforward microphones. In other implementations, one or more microphones inside the earphone 10 may be used to augment speech pickup from the user and one or more external microphones can be used for hearing assistance or ambient pass-through. By way of non-limiting examples, the earphone 10 may be used in different types of devices such as devices that provide for music playback, communications, hearing assistance and/or augmented reality.

As illustrated, the speaker 12 is provided at an acute angle with respect to a length of the front cavity 16 which extends from a region adjacent to the speaker 12 to the acoustic opening. In other examples, the speaker 12 is located at the end of the rigid body 14A such that the acoustic energy from the speaker is directed substantially along the length of the front cavity 16.

The front cavity 16 is an open cavity while the earphone 10 is not worn; however, when the earphone 10 is inserted into the entrance of the ear canal 20, the front cavity 16 and the ear canal 20 couple together to form an acoustic cavity referred to as an occluded ear canal. The occluded ear canal behaves substantially as an acoustic waveguide. The ear drum 22 is located at one end of the occluded ear canal and the speaker 12 and front cavity 16 are located at the other end of the occluded ear canal. The figure omits most of the length of the ear canal to accommodate for scale and for clarity of the illustrated features. By way of example, the length of the ear canal of a user is typically in a range from about 2 cm to about 3 cm.

A rigidly terminated acoustic waveguide is known to have a first resonance at a frequency where the length of the waveguide is equal to a half-wavelength of propagating acoustic waves. This first resonance frequency depends on several factors, including, but not limited to, the length of the ear canal, the earphone insertion depth and the volume of the front cavity 16. For typical earphones the first resonance frequency is in a frequency range extending from about 4 kHz to about 8 kHz.

The first resonance of the occluded ear canal causes undesirable effects for a number of reasons. First, for passive noise-isolating earphones and active noise reduction (ANR)

earphones, the resonance amplifies the transmission of external noise into the ear canal and therefore reduces the amount of passive noise attenuation around the first resonance frequency. The reduced attenuation is particularly noticeable in ANR earphones because the active components of noise reduction typically include a feedback system and feedforward system, both of which contribute to noise reduction primarily at frequencies below the first resonance frequency. Consequently, the total noise reduction is greatest at frequencies below the first resonance frequency, small around the resonance frequency, and moderate at frequencies that are greater than the resonance frequency. It should be recognized that there are higher order resonances defined by the occluded ear canal; however, these resonances occur at higher frequencies where hearing is less sensitive and these resonances interact with other dynamic features so their effects are not as consistently prominent as the first resonance.

Figure 2:
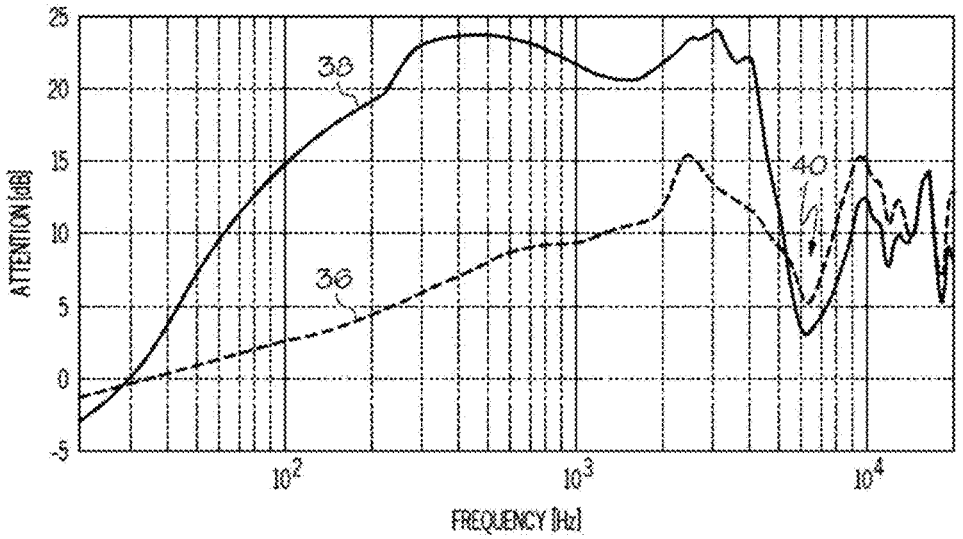
FIG. 2 is a graphical representation of an example of the passive attenuation and total attenuation of an acoustic noise reduction earphone as a function of acoustic frequency.

FIG. 2 shows an example of the noise attenuation achieved by an ANR earphone as a function of acoustic frequency. A typical ANR earphone system includes one or more feedforward microphones disposed on the external surface of the earphone, one or more feedback microphones disposed in the front cavity of the earphone and a circuit in electrical communication with the microphones. The circuit generates an electrical signal to drive the speaker based, for example, on an audio playback signal. The electrical signal is also responsive to the feedback and feedforward electrical signals generated by the microphones that are used for noise reduction.

The figure shows the attenuation as a function of acoustic frequency. The total attenuation 38 represents the sum of the active (i.e. feedback and/or feedforward) attenuation and the passive attenuation 36. The negative effect of the ear canal resonance on the passive attenuation 36, and therefore on the total attenuation 38, is evident as the "notch" 40 at approximately 7 kHz.

It should be noted that a second undesirable effect of the occluded ear canal resonance is the amplification of the speaker response at and around the resonance frequency, which is generally problematic for audio playback.

Examples of earphones described below include an impedance branch in acoustic communication with the front cavity of the earphone to effectively modify the boundary condition of the waveguide defined by the occluded ear canal. The acoustic impedance branch yields a reduction in the undesirable effects from the first resonance frequency. Consequently, the quality factor (Q) of the occluded ear canal is reduced and a substantially flatter spectral audio response is achieved.

Figure 3:
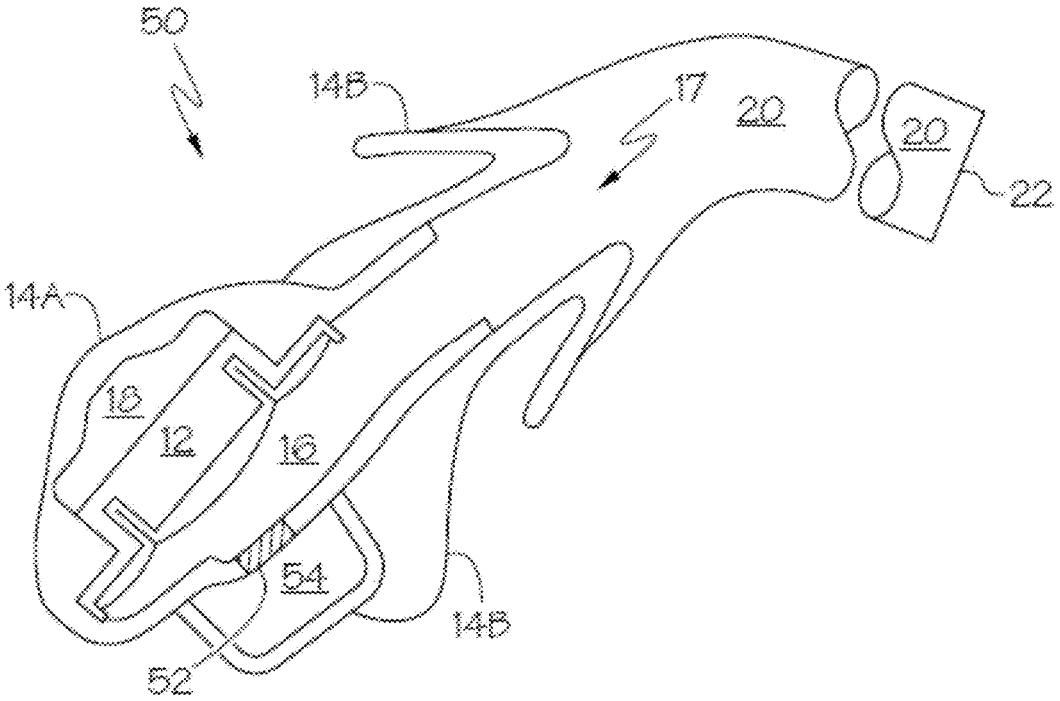
FIG. 3 is an illustration of an example of an earphone having an acoustic circuit that includes an acoustic impedance branch.

FIG. 3 shows an example of an earphone 50 in which an acoustic circuit, defined in part by the acoustic impedance branch, acts in an analogous way to an electronic series resistor and capacitor (RC) circuit. In particular, the acoustic impedance branch includes an acoustic resistive element 52. The acoustic impedance branch also includes a "branch volume" cavity 54 which acts as a capacitance or compliance in the acoustic circuit. Examples of acoustic resistive elements 52 include an acoustic screen, a wire mesh, an acoustic fabric and other substantially planar acoustic resistive elements. In one example, the acoustic resistive element 52 is Saati Acoustex woven mesh available from Saati Americas Corporation of Fountain Inn, S.C. In an alternative example, the acoustic mesh is available from Sefar AG of Heiden, Switzerland. The acoustic resistive element 52 is located at an impedance aperture where the front cavity 16 is in communication with the branch volume 54.

The acoustic RC circuit has a corner frequency $f_c$ at which the impedance magnitudes of the acoustic resistance and acoustic capacitance are equal. When the corner frequency $f_c$ is set to be approximately equal to the first resonance frequency of the occluded ear canal, the acoustic resistance and acoustic capacitance are in balance to allow acoustic energy into the acoustic impedance branch and to dissipate that acoustic energy. Although the corner frequency $f_c$ is set to be approximately equal to (i.e., substantially equal to) the first resonance frequency, the acoustic RC circuit may be detuned by a small frequency offset so that the two frequencies are not exactly equal. For example, the corner frequency $f_c$ can be tuned to a value within a 20% range of the first resonance frequency (i.e., at a frequency that is 1.8 to 2.2 times the first resonance frequency). If the corner frequency $f_c$ is detuned to be slightly less than the first resonance frequency, the effective first resonance of the occluded ear canal may shift to a frequency that is closer to the second resonance of the open ear. It will be recognized in connection with alternative examples described below that similar detuning with respect the first resonance yields similar beneficial effects.

As a result of the acoustic RC circuit, the Q of the first resonance is reduced. The size of the branch volume 54 relative to the volume of the occluded ear canal substantially determines how much the Q is reduced. By way of example, the branch volume 54 may be less than 0.02 $cm^3$ to more than 0.2 $cm^3$ while the volume of the occluded ear canal is dependent on the volume of an "open" ear canal (typically in a range between about 1.0 $cm^3$ and 1.4 $cm^3$), the insertion depth of the earphone and the volume of the front cavity.

In one non-limiting numerical example, the branch volume 54 is 0.05 $cm^3$, the impedance aperture has a radius of 1.2 mm and the acoustic resistive element 52 is an acoustic screen having an acoustic resistance of 260 rayl.

Figure 4:
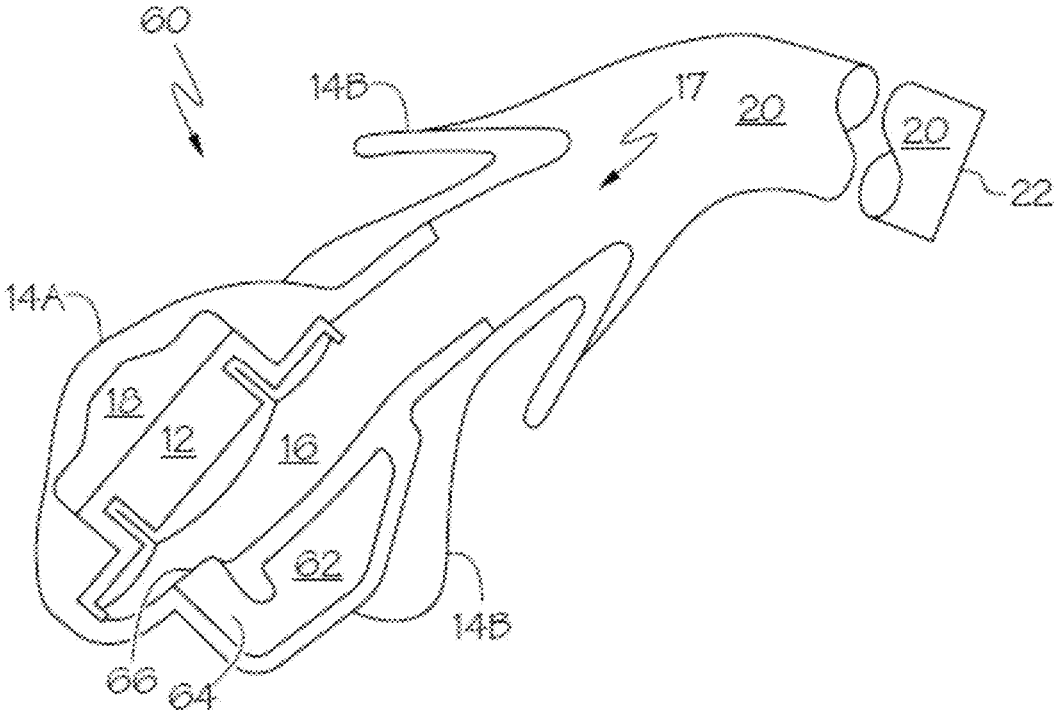
FIG. 4 is an illustration of another example of an earphone having an acoustic circuit that includes an acoustic impedance branch.

FIG. 4 shows an example of an earphone 60 in which an acoustic circuit defined by the acoustic impedance branch acts in a similar way to an electrical resistor, inductor and capacitor (RLC) circuit. The acoustic impedance branch includes a branch volume 62, an acoustic channel 64 (e.g. a thin tube) extending from the branch volume 62 to the front cavity 16, and an acoustic resistive element 66. The acoustic channel 64 acts as an inductor or mass and the branch volume 62 acts as a capacitance or compliance. This type of circuit is commonly referred to as a Helmholtz Resonator and has a resonance frequency $f_{hr}$.

The acoustic resistive element 66 may be at the impedance aperture defined at the boundary between the front cavity 16 and the acoustic port, as shown in the figure, or may be located at the boundary between the acoustic channel 64 and the branch volume 62. Alternatively or in addition, an acoustic resistive element may be a volume acoustic resistive element disposed in at least a portion of the acoustic channel 64. For example, an acoustically resistive foam may be provided which partially or fully occupies the acoustic channel 64. By way of a specific example, the acoustically resistive foam may be melamine foam.

When the acoustic Helmholtz Resonator frequency $f_{hr}$ is tuned appropriately with respect to the first resonance frequency of the occluded ear canal (e.g., within a frequency offset range that is within 20% of the first resonance frequency), a significant reduction in the first resonance occurs. Analogous systems are often used to manage mechanical vibrations and are referred to as tuned mass dampers or damped vibration absorbers where such systems are tuned to damp vibrations as is known in the mechanical arts. It should be recognized that the structure of the ear canal can vary for different users. Consequently, an earphone assembly that may be optimally configured for one user may be mistuned for another user so that the damping of the first resonance is less.

In one non-limiting numerical example, the branch volume 62 is 0.052 $cm^3$, the impedance aperture has a radius of 1.0 mm, the acoustic channel 64 has a length of 2.5 mm and the acoustic resistive element 66 is an acoustic screen having an acoustic resistance of 140 rayl.

In an alternative example to the Helmholtz Resonator configuration, a waveguide can be used in place of the acoustic channel and branch volume. For example, the waveguide may be formed as a channel in the rigid body 14A of the earphone assembly 14. The waveguide may have a constant cross-sectional area. Alternatively, the waveguide may have a cross-sectional area that varies along its length, for example a conical or an exponential waveguide. To reduce the first resonance of the occluded ear canal, the length of the waveguide may be tuned to have a first resonance frequency that is approximately equal to the first resonance frequency of the occluded ear canal. For example, the length of a constant-area waveguide may be approximately one quarter of the wavelength for the expected first resonance frequency.

Figure 5:
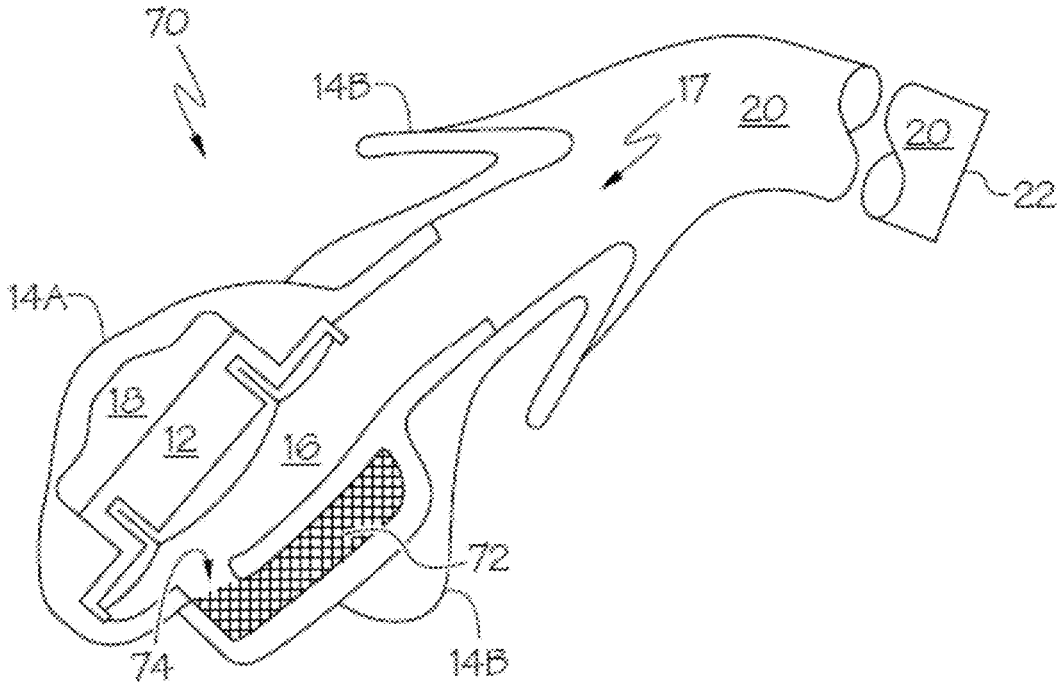
FIG. 5 is an illustration of an example of an earphone having a foam shunt acoustically coupled to a front cavity of the earphone.

FIG. 5 shows an example of an earphone 70 in which a foam shunt 72 is acoustically coupled at the impedance aperture 74 to the front cavity 16 while the remainder of the foam shunt 72 is surrounded by the rigid body 14A. The foam shunt 72 acts as a fluid having a density and speed of sound which are generally complex-valued parameters in which the imaginary component is associated with an acoustic resistance. An appropriate foam has an acoustic resistance that is sufficient to allow acoustic energy to couple into the acoustic impedance branch and to dissipate the coupled acoustic energy. Melamine foam is one example of a foam that may be used to form the foam shunt 72.

In a variation of the illustrated example, the foam shunt 72 can have a geometric form such that the foam shunt 72 acts as a waveguide having a first resonance tuned approximately equal to the first resonance frequency of the occluded ear canal. The waveguide may have constant or varying cross-sectional area along its length. In this configuration, the foam shunt 72 acts as a tuned mass damper that significantly reduces the Q of the first resonance.

Figure 6:
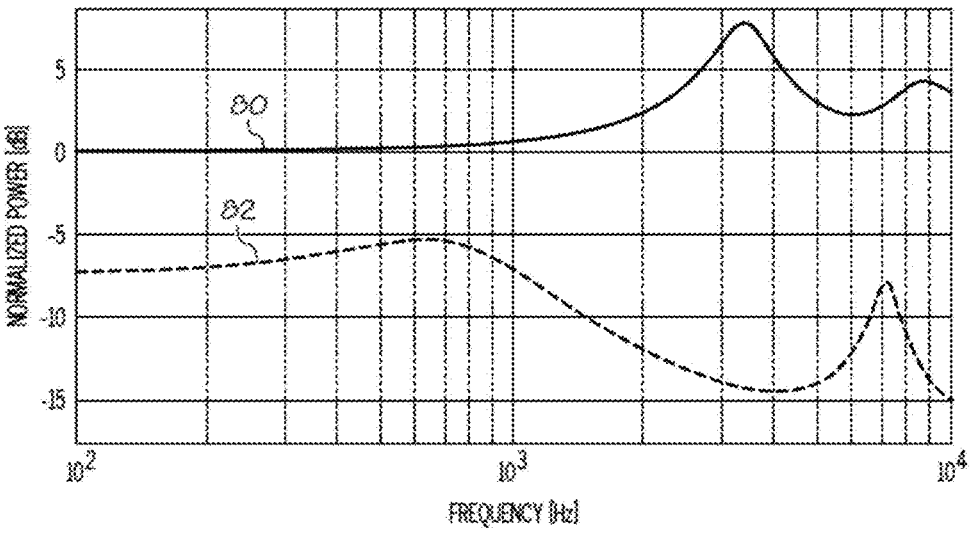
FIG. 6 is a graphical representation of an example of acoustic power received at an eardrum as a function of acoustic frequency for an open ear canal and for an ear canal occluded by an earphone providing only passive attenuation.

The earphone examples described above illustrate how the Q of the first resonance can be reduced. As a result, the undesirable effects of the first resonance of an occluded ear canal on the passive noise attenuation can be reduced. An example of passive attenuation as a function of acoustic frequency is shown in FIG. 6 in which one response 80 corresponds to acoustic power received at the ear drum as a function of acoustic frequency for an open ear canal and the other response 82 corresponds to the acoustic power received at the ear drum as a function of acoustic frequency while a nominal earphone providing only passive attenuation is inserted into the entrance of the ear canal. The amount of passive attenuation is defined as the difference between the two responses 80 and 82. The passive attenuation corresponds to a diffuse noise field and the responses are normalized to the acoustic power received at the ear drum for the open ear canal at zero frequency. The first resonance frequency is evident in the inserted earphone response 82 at a frequency of approximately 7 kHz.

Figure 7:
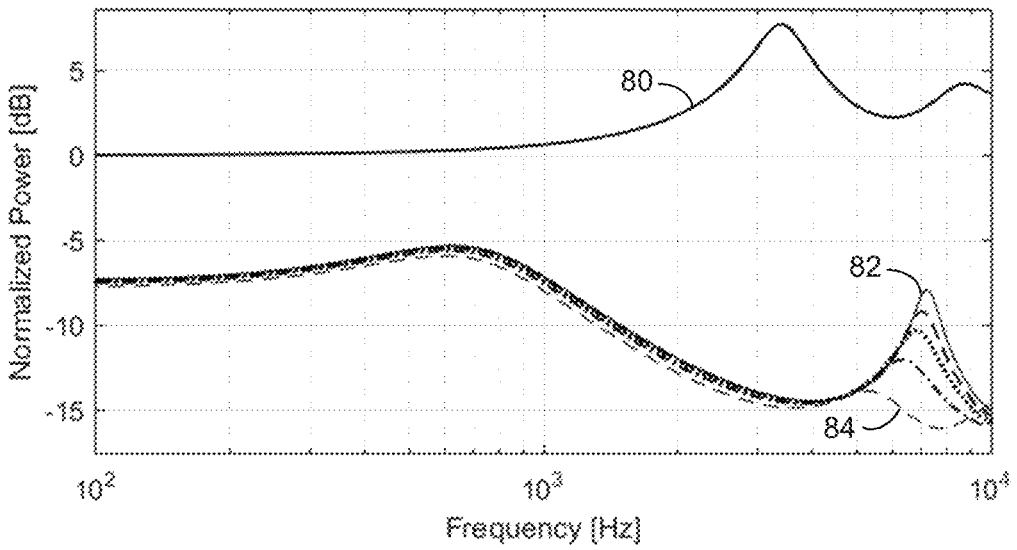
FIG. 7 is a graphical representation of an example of the normalized acoustic power at the ear drum as a function of acoustic frequency for an open ear, an ear canal occluded by an earphone having only passive attenuation and for an ear canal occluded by an earphone configured according to FIG. 3 for four different branch volumes.

FIG. 7 graphically shows the normalized acoustic power at the ear drum as a function of acoustic frequency for the open ear and nominal passive attenuation earphone (responses 80 and 82, respectively) as described above with respect to FIG. 6. FIG. 7 also shows the acoustic power at the eardrum as a function of acoustic frequency for four different earphones with each earphone configured with an acoustic impedance branch having a planar acoustic resistive element and a branch cavity as described above for FIG. 3. The four earphones have branch volumes of 0.025 $cm^3$, 0.05 $cm^3$, 0.10 $cm^3$ and 0.20 $cm^3$. It can be seen that the first resonance decreases monotonically both in magnitude and in acoustic frequency with increasing values of branch volume with the response 84 corresponding to the branch volume of 0.20 $cm^3$. An upper limit to the branch volume typically is due to the available space within the earphone body.

Figure 8:
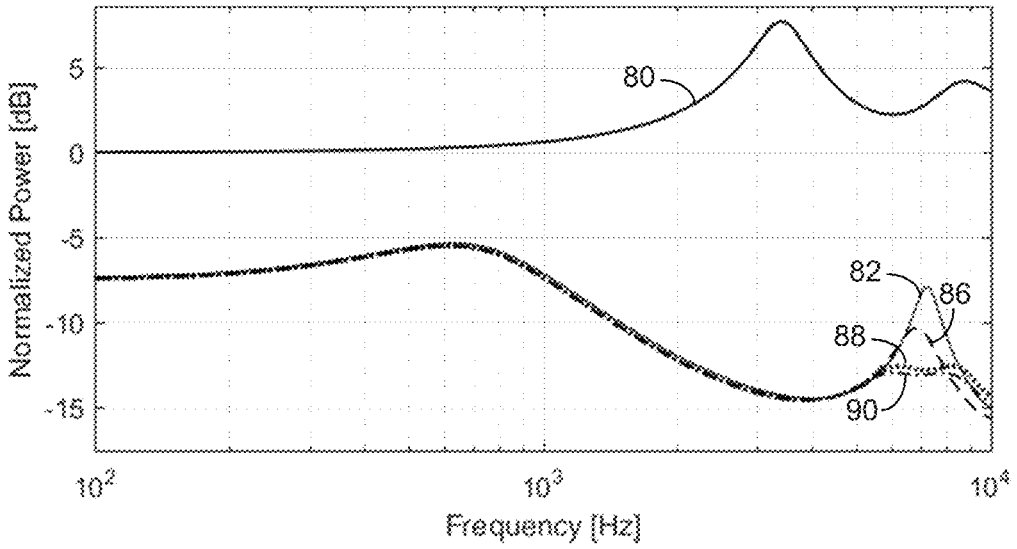
FIG. 8 is a graphical representation of an example of the normalized acoustic power at the ear drum as a function of acoustic frequency for an open ear, an ear canal occluded by a nominal passive attenuation earphone and for ear canals occluded by an earphone configured according to one of FIG. 3, FIG. 4 and FIG. 5 with a branch volume of 0.05 $cm^3$.

FIG. 8 graphically shows the normalized acoustic power at the ear drum as a function of acoustic frequency for the open ear and nominal passive attenuation earphone (responses 80 and 82, respectively) as described above with respect to FIG. 6. FIG. 8 also shows the acoustic power at the eardrum as a function of acoustic frequency for an earphone constructed according to the acoustic screen and branch volume configuration of FIG. 3, the Helmholtz Resonator configuration of FIG. 4 and the foam resonator configuration of FIG. 5 (responses 86, 88 and 90, respectively). All branch volumes are 0.05 $cm^3$.

One significant advantage of various examples of earphones described above relates to the ability to control, and specifically, flatten the amplification of the speaker response in the feedback system. More specifically, a feedback controller can include frequency response features that remove the amplifying effect of the ear canal resonance on the speaker-to-feedback microphone response. Decreasing the magnitude of the resonance with an acoustic impedance branch permits a more robust feedback system to accommodate the effects of an occluded ear canal resonance.

Figure 9:
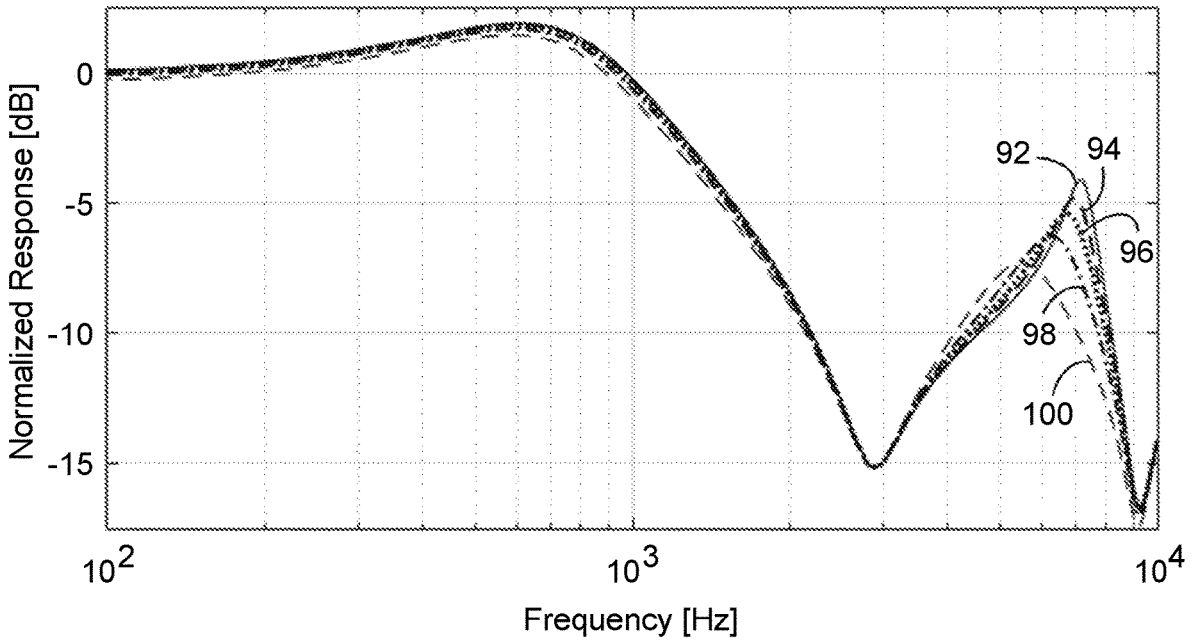
FIG. 9 is a graphical representation of a normalized speaker-to-feedback microphone response showing how the response improves with increasing branch volume of an acoustic impedance branch.

FIG. 9 is an example of how the speaker-to-feedback microphone response improves with increasing branch volume. Response 92 corresponds to a nominal passive-only attenuating earphone and responses 94, 96, 98 and 100 correspond to branch volumes of 0.025 $cm^3$, 0.05 $cm^3$, 0.10 $cm^3$ and 0.20 $cm^3$, respectively.

As described above, in some earphones the acoustic back cavity 18 (see FIG. 3) may be shunted (ported) by an impedance path to the acoustic front cavity 16. Furthermore, the front cavity 16 may be shunted to the external acoustic environment. Such ports may be used for low frequency pressure equalization and referred to as PEQ ports. For example, a PEQ port may be implemented as a narrow tube. Alternatively, one or more PEQ ports may shunt between the acoustic impedance branch and the back cavity 18 and/or between the acoustic impedance branch and the external acoustic environment. These alternative configurations are possible because the acoustic impedance branch is in acoustic communication with the front cavity 16 and may be configured to be effectively open to the front cavity 16 below several kHz. Consequently, low frequency acoustic energy from the PEQ port(s) passes through the acoustic impedance branch to the front cavity 16 and vice versa. In addition, PEQ ports may be configured to be effectively closed above several hundred Hz. Thus, the PEQ ports have no substantial influence on the effect of the acoustic impedance branch on the first resonance of the occluded ear canal.

Although the various examples described above include the acoustic impedance branch as located within the rigid body of an earphone assembly, in alternative examples the acoustic impedance branch is partially or fully located in the eartip. For example, part of the branch cavity or the entire branch cavity may be formed in the eartip.

Figure 10:
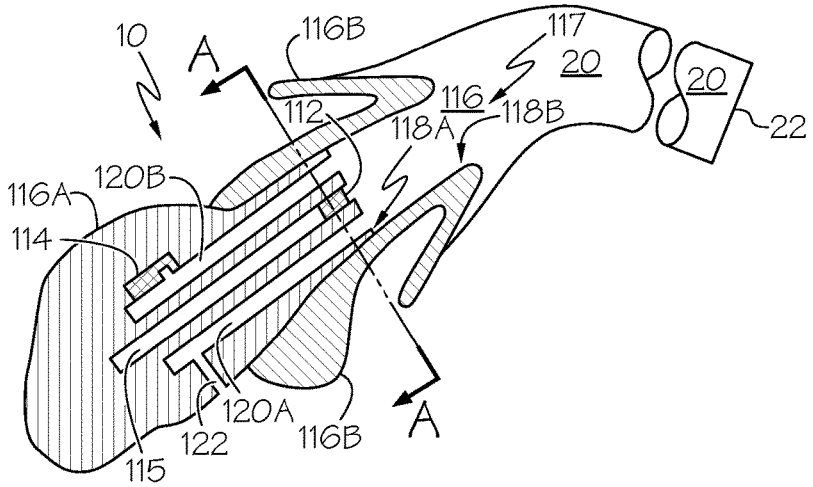
FIG. 10 is a cross-sectional side view of an earphone assembly having two electro-acoustic transducers and two acoustic waveguides.

In the various examples described above, a single electroacoustic transducer 12 for sourcing an acoustic signal is disposed inside the earphone assembly. In the following examples, one or more additional electro-acoustic transducers may be included in the earphone assembly. In these examples, an additional electro-acoustic transducer is disposed in an acoustic impedance branch that is in the form of a waveguide. For example, FIG. 10 illustrates an earphone 110 that includes a first electro-acoustic transducer (speaker) 112 and a second electro-acoustic transducer 114 inside a rigid body 116A that is attached to a compliant eartip 116B. The first speaker 112 separates a back cavity 115 and a front cavity 116 and is configured to generate a first acoustic signal in response to a first electrical signal. Although shown as a long, thin cavity extending away from the nozzle end of the earphone 110, the back cavity 115 can have a substantially different shape subject to the shape and size constraints of the rigid body 116A. The second speaker 114 is configured to generate a second acoustic signal in response to a second electrical signal. The first and second acoustic signals may differ such that the first and second speakers 112 and 114 generate acoustic signals having different amplitudes and frequency content. The earphone 110 has an acoustic opening 117 at the open end of the eartip 116B which, in combination with the inner surfaces 118A and 118B of the rigid body 116A and eartip 116B, respectively, define the front cavity 116 of the earphone. Optionally, the earphone 110 may include one or more internal and/or external microphones such as feedback microphones and/or feedforward microphones. When the earphone 110 is at least partially inserted into the entrance of the ear canal 20, an acoustic cavity is defined by the occlusion of the ear canal. This acoustic cavity and includes the earphone front cavity 116 and the portion of the ear canal that is not occupied by the earphone 110.

Two acoustic impedance branches in the form of acoustic waveguides 120A and 120B are formed in the rigid body 116A. Each waveguide 120 has a substantially constant cross-sectional area and a length that is approximately one quarter of the wavelength of the expected first resonance frequency. In some implementations, the lengths of the waveguides 120 are in a range from about 10 mm to about 15 mm and the total cross-sectional area of each waveguide 120 is in a range from about 2.0 $mm^2$ to about 5.0 $mm^2$. Larger cross-sectional areas are sometimes preferred but are limited by the size of the rigid body 116A. Each waveguide 120 extends from an aperture at the inner surface 118A to a closed end inside the rigid body 116A. As illustrated, one of the waveguides 120A is shunted to the external environment through a port 122. Optionally, the other waveguide 120B can instead be shunted to the external environment or both waveguides 120A and 120B may be shunted.

The first speaker 112 is disposed near or at the nozzle end of the rigid body 116A close to the acoustic opening 117 such that acoustic energy generated by the first speaker 112 couples directly into the ear and propagates substantially down the length of the ear canal 20. The second speaker 114 is disposed inside the rigid body 116A along a length of the other waveguide 120B and includes an acoustic aperture 124 through which acoustic energy generated by the second speaker 114 is introduced into the waveguide 120B which couples at one end into the acoustic cavity of the occluded ear canal. As illustrated, the acoustic aperture 124 is located away from the closed end of the waveguide 120B by approximately one quarter of the waveguide length. In other examples, the second speaker 114 and acoustic aperture 124 are located at a different position along the length of the waveguide 120B.

Figure 11:
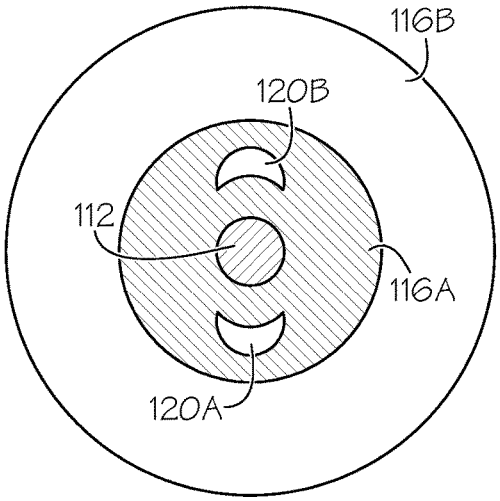
FIG. 11 is a section view of the earphone assembly of FIG. 10 and shows the position of two waveguides relative to one of the electro-acoustic transducers.

FIG. 11 is a cross-sectional view of the earphone 110 of FIG. 10 looking inward from the nozzle end and shows the two waveguides 120 relative to the first speaker 112. The cross-sectional shape of each waveguide 120 is a lune, i.e., the area formed by the intersection of two non-concentric circular arcs. The lune shape efficiently addresses space constraint at the nozzle end of the rigid body 116A where the first speaker 112 is also present. Other cross-sectional shapes with similar or different areas can be used within the available space of the rigid body 116A.

Preferably, each speaker 112 and 114 provides an acoustic signal having different frequency content. For example, the first speaker 112 may provide substantial bass coverage and the second speaker 114 may provide higher frequency content. The speakers 112 and 114 may be of different size. By way of non-limiting numerical examples, one or both speakers 112 and 114 may be a balanced armature speaker and can range in size from smaller than a 5 mm×2.7 mm×1 mm device to a greater than 9.5 mm×7 mm×4 mm device. Alternatively, one or both speakers 112 and 114 may be a dynamic (moving coil) speaker and can range in size from a substantially cylindrical device that is smaller than a 4 mm diameter and 4 mm length device to larger than a 9 mm in diameter and 5 mm length device. In still another example, one or both speakers 112 and 114 may be piezoelectric transducers.

In other examples, waveguides may have a different shape, such as a circular or rectangular cross-section. In addition, the number of waveguides may be different. For example, a single waveguide may be used (e.g., waveguide 120A may be absent). Alternatively, three or more waveguides may be included in the earphone.

The number of speakers may be different. In contrast to FIG. 10, each waveguide 120 may have a speaker disposed along its length. More specifically, a third speaker may be coupled to the waveguide 120A or the first speaker may be relocated to a position along the length of the waveguide 120A. In still other examples, the number of waveguides 120 may be different and the number of speakers coupled to waveguides may be different.

Figure 12:
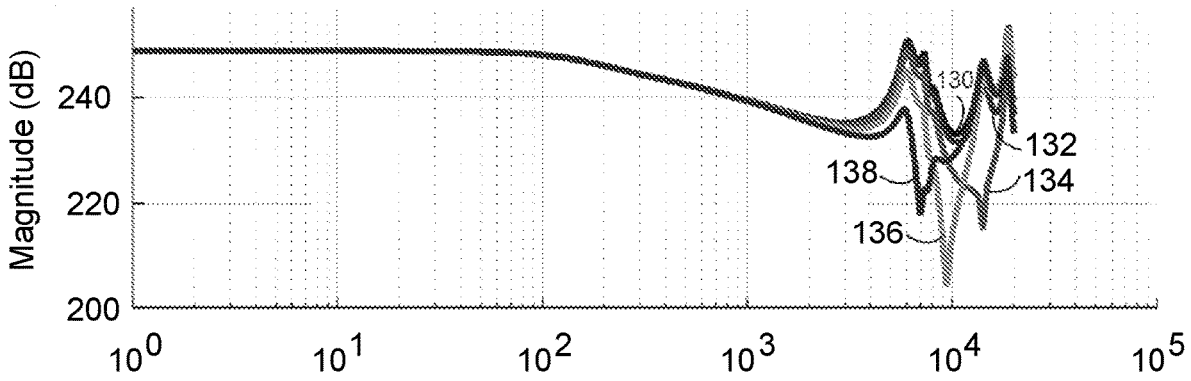
FIG. 12 is a graphical representation of the magnitude of an acoustic signal from an electro-acoustic transducer as a function of acoustic frequency for different locations of the electro-acoustic transducer along the length of an acoustic waveguide.

The performance of a speaker that is coupled into a waveguide depends on the location of the speaker along the length of the waveguide. FIG. 12 graphically illustrates the magnitude of the speaker-to-feedback microphone response for a balanced armature transducer as a function of acoustic frequency for different locations of the speaker aperture along the length of a constant cross-sectional area waveguide having a length of 12 mm and a circular cross-sectional area of approximately 1.25 $mm^2$. The location of the speaker associated with each plot corresponds to the distance of the acoustic aperture (e.g., acoustic aperture 124 in FIG. 10) from the closed end of the waveguide.

Response 130 corresponds to the speaker located at the closed end of the waveguide, responses 132, 134 and 136 correspond to the speaker positioned at 3 mm, 6, mm and 9 mm from the closed end, respectively, and response 138 corresponds to the speaker at the open end of the waveguide (similar to the location of the first speaker 112 in FIG. 10).

The response magnitudes are nearly identical for acoustic frequencies less than about 3 kHz. At higher frequencies, the peaks and notches in the magnitude responses vary according to speaker position along the waveguide.

The available space for speakers within an earbud or other types of earphone is often limited, especially in the region nearest to the earphone nozzle. As described above, if the earphone includes one or more acoustic impedance branches to modify the ear canal first resonance frequency, a speaker can be coupled to the acoustic impedance branch at a location away from the nozzle where more space is available. The additional space allows a larger sized speaker to be used and, in some implementations, allows for an increased number of speakers. Thus, a waveguide or other form of acoustic impedance branch used to achieve a desired modification to the occluded ear canal resonance can also be used for the additional independent advantage of coupling an acoustic signal from one or more additional speakers to the ear canal.

A number of implementations have been described. Nevertheless, it will be understood that the foregoing description is intended to illustrate, and not to limit, the scope of the inventive concepts which are defined by the scope of the claims. Other examples are within the scope of the following claims.

What is claimed is:

1. An earphone comprising:

an earphone assembly having an earphone body with an inner surface, an acoustic opening and a cavity defined by the inner surface and the acoustic opening, the earphone assembly further including a first acoustic impedance branch extending from the cavity at an open end at the inner surface to a closed end inside the earphone body, wherein the first acoustic impedance branch includes a branch volume that reduces a magnitude of a resonance at a first resonance frequency for an occluded ear canal defined by the cavity of the earphone assembly and an ear canal of a user when the earphone is at least partially inserted into the ear canal;

a first electro-acoustic transducer disposed inside the earphone assembly and configured to generate a first acoustic signal in response to a first electrical signal; and a second electro-acoustic transducer disposed inside the earphone body along a length of the first acoustic impedance branch and configured to generate a second acoustic signal in response to a second electrical signal.

2. The earphone of claim 1 wherein the first acoustic impedance branch comprises an acoustic waveguide.

3. The earphone of claim 2 wherein the waveguide has a length equal to one quarter of an acoustic wavelength for the first resonance frequency.

4. The earphone of claim 1 wherein the first electro-acoustic transducer is disposed at the inner surface of the earphone body.

5. The earphone of claim 1 wherein the second electro-acoustic transducer is disposed at the closed end of the first acoustic impedance branch.

6. The earphone of claim 1 wherein the earphone assembly further includes a second acoustic impedance branch extending from the inner surface into the earphone body.

7. The earphone of claim 6 wherein the first electro-acoustic transducer is disposed inside the earphone body along a length of the second acoustic impedance branch.

8. The earphone of claim 7 wherein the first electro-acoustic transducer is disposed at a closed end of the second acoustic impedance branch.

9. The earphone of claim 1 wherein the first electro-acoustic transducer and the second electro-acoustic transducer generate acoustic signals having different frequency content.

10. The earphone of claim 1 wherein the first electro-acoustic transducer and the second electro-acoustic transducer are different sizes.

11. An acoustic noise reduction earphone comprising:

an earphone assembly having an earphone body with an inner surface and an external surface, an acoustic opening and a cavity defined by the inner surface and the acoustic opening, the earphone assembly further including a first acoustic impedance branch extending from an open end at the inner surface to a closed end inside the earphone body, wherein the first acoustic impedance branch includes a branch volume that reduces a magnitude of a resonance at a first resonance frequency for an occluded ear canal defined by the cavity of the earphone assembly and an ear canal of a user when the earphone is at least partially inserted into the ear canal;

a first electro-acoustic transducer disposed inside the earphone assembly and configured to generate a first acoustic signal in response to a first electrical signal;

a second electro-acoustic transducer disposed inside the earphone body along a length of the acoustic impedance branch and configured to generate a second acoustic signal in response to a second electrical signal;

at least one of a feedforward microphone disposed on the external surface of the earphone body and configured to generate a feedforward electrical signal in response to an external acoustic signal and a feedback microphone disposed in the cavity and configured to generate a feedback electrical signal in response to a cavity acoustic signal; and a circuit in electrical communication with the first and second electro-acoustic transducers and the at least one of a feedforward microphone and feedback microphone, the circuit generating the first and second electrical signals received by the first and second electro-acoustic transducers, respectively, in response to the at least one of the feedback electrical signal and the feedforward electrical signal.

12. The earphone of claim 11 wherein the first acoustic impedance branch comprises an acoustic waveguide.

13. The earphone of claim 12 wherein the waveguide has a length equal to one quarter of an acoustic wavelength for the first resonance frequency.

14. The earphone of claim 11 wherein the first electro-acoustic transducer and the second electro-acoustic transducer generate acoustic signals having different frequency content.

15. An earphone comprising:

an earphone assembly having an earphone body with an inner surface, an acoustic opening and a cavity defined by the inner surface and the acoustic opening, the earphone assembly further including a waveguide having a length equal to one quarter of an acoustic wavelength for the first resonance frequency and extending from an open end at the inner surface to a closed end inside the earphone body, wherein the waveguide reduces a magnitude of a resonance at a first resonance frequency for an occluded ear canal defined by the cavity of the earphone assembly and an ear canal of a user when the earphone is at least partially inserted into the ear canal;

a first electro-acoustic transducer disposed in the earphone assembly and configured to generate a first acoustic signal in response to a first electrical signal; and a second electro-acoustic transducer disposed in the earphone body along a length of the waveguide and configured to generate a second acoustic signal in response to a second electrical signal.

16. The earphone of claim 15 wherein the first electro-acoustic transducer is disposed at the inner surface of the earphone body.

17. The earphone of claim 15 wherein the second electro-acoustic transducer is disposed at the closed end of the waveguide.

18. The earphone of claim 15 wherein the first electro-acoustic transducer and the second electro-acoustic transducer generate acoustic signals having different frequency content.

19. The earphone of claim 15 wherein the first electro-acoustic transducer and the second electro-acoustic transducer are different sizes.

* * * * *